US006322147B1

(12) United States Patent
Leib

(10) Patent No.: US 6,322,147 B1
(45) Date of Patent: Nov. 27, 2001

(54) UTILITY CHAIR

(76) Inventor: Roger K. Leib, 208 S. McCadden Pl., Los Angeles, CA (US) 90004-1054

( * ) Notice: Subject to any disclaimer, the term of this patent is extended or adjusted under 35 U.S.C. 154(b) by 0 days.

(21) Appl. No.: 08/550,955

(22) Filed: Oct. 31, 1995

(51) Int. Cl.[7] ..... A47C 7/02

(52) U.S. Cl. ..... 297/452.19; 297/452.13; 297/452.3

(58) Field of Search ..... 297/452.19, 452.13, 297/452.2, 452.3, 452.18, 218.4, 445.1, 448.1, 450.1

(56) References Cited

U.S. PATENT DOCUMENTS 2,512,353 * 6/1950 Megaldino et al. ..... 297/452.13 X
3,035,866 * 5/1962 Raduno ..... 297/452.2 X
3,310,343 * 3/1967 Schultz ..... 297/452.13 X
3,851,914 * 12/1974 Nii ..... 297/452.13 X
5,411,317 * 5/1995 Faust et al. ..... 297/452.3

* cited by examiner

*Primary Examiner*—Laurie K. Cranmer
(74) *Attorney, Agent, or Firm*—Sheldon & Mak

(57) ABSTRACT

A chair includes a base, a substantially rigid seat and back supporting frame, and a tensile support tensioned on the frame by a combination of elements of the base, the frame, and a spreader bar that extends between upper portions of the frame has a side profile generating a lumbar support that is particularly comfortable for users having a variety of physical characteristics.

21 Claims, 6 Drawing Sheets

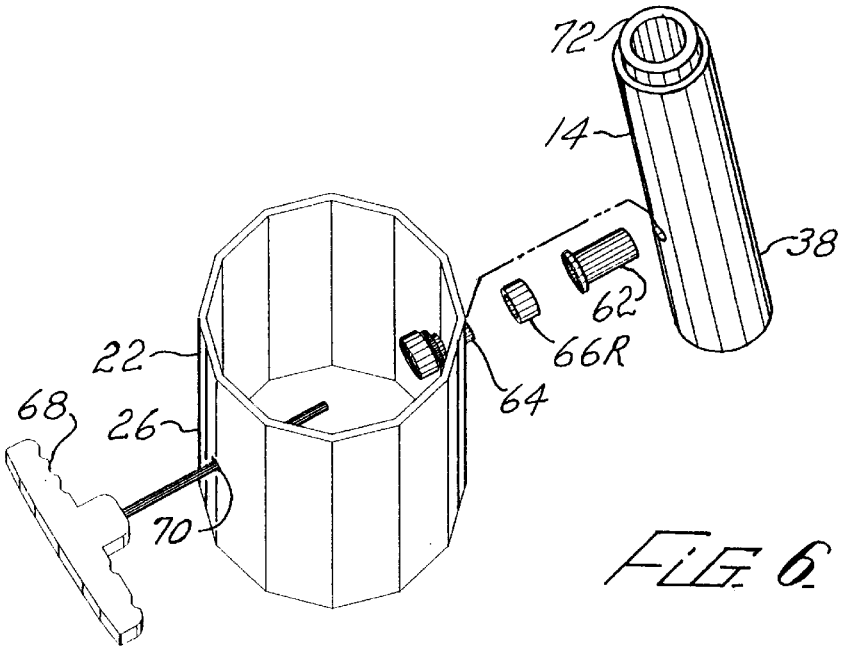
FIG. 6
FIG. 5
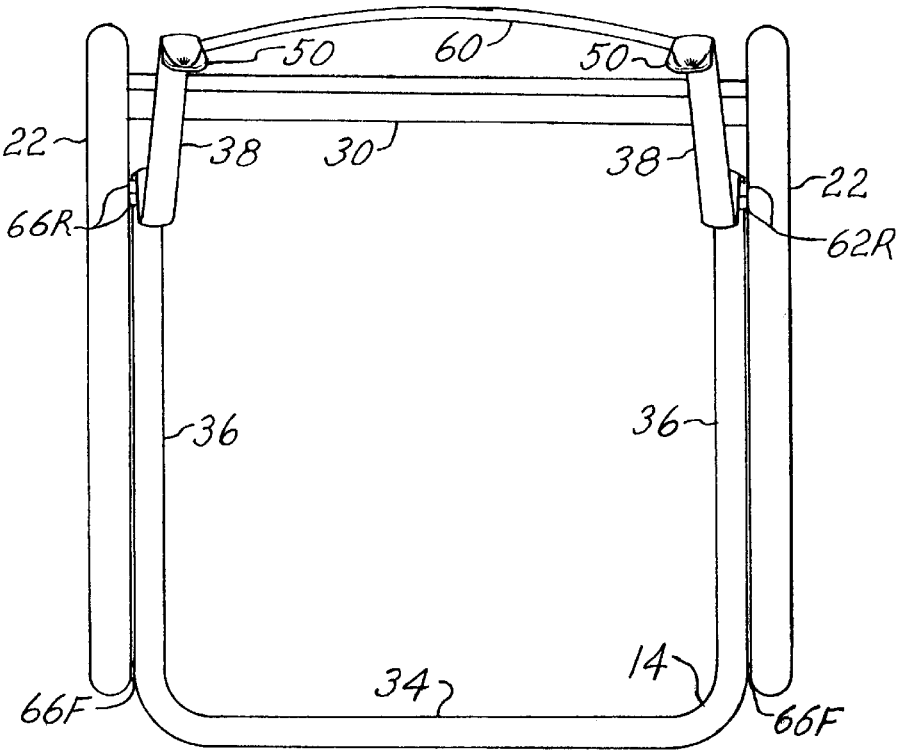

14
8.34
10.62
2 1/8
4
34
82.1°
36
14 1/2
6.03
128.5°
R4.5
RC
R2
11.5
47.8°
1.7°
R45.5
92
94
38
5.13
R5.5
96
R15.5
R28.97
R26.5
11.7
12.7
1.7
5.8
R5.56
7.03
X

UTILITY CHAIR

BACKGROUND

The present invention relates to chairs for use in offices and in institutional settings such as patient care facilities.

Special purpose patient chairs are disclosed, for example, in U.S. Pat. No. 4,555,139 to the above-identified inventor. Similar chairs having broader application are disclosed in U.S. Pat. No. 4,784,435 to the same inventor, both patents being commonly owned with the instant invention, the disclosures thereof being incorporated herein by this reference. Disclosed therein are laterally spaced seat and back-supporting members that are formed of high-strength spring material and having a flexible member extending therebetween for forming seat and back portions of the respective chairs. The seat and back-supporting members, which are rigidly spaced apart by a plurality of cross-members, have reverse curvature for providing lumbar support by the back portion. The above chairs are adapted for facilitating cleanliness in that the flexible members are thin, perforate and non-absorbent, having imperforate margins that enclose upper extremities of the seat and back-supporting members in a shape having low plan surface area at the top of the chairs to avoid collecting food or other waste matter.

The '139 patent discloses a chair having arms extending forwardly of the seat and having rigid front supports, the seat and back-supporting members being connected to the front supports for imparting significant springiness to the chair seat and back to enable infirm patients to easily rise from the seat while grasping the arms proximate the front supports. The '435 patent discloses a chair having arms extending forwardly to rigid supports that are approximately even with the seat front, the seat and back-supporting members being attached to the rigid front supports with resilient mountings for preserving a desired degree of springiness with the seat and back-supporting members being significantly foreshortened as compared with the '139 disclosure. In applications not requiring extreme ease of egress, the '435 disclosure provides a chair that is significantly more compact and inexpensive to produce. However, in some related applications the springiness of the above chairs is actually excessive, being potentially distractive to occupants of the chairs and persons nearby. Also, the seat and back-supporting members of the '435 chair remain undesirably expensive to produce, and they require critical quality assurance and monitoring.

Inexpensive, rigid chairs are known, and tensile sling chairs also include "director's chairs", "butterfly" lawn-type chairs, and outdoor folding chairs. None of the sling chairs is believed to be particularly comfortable, because the supporting structure fails to provide a desired combination of shaping and tensioning of the material of the sling components. It is believed that none of the chairs of the prior art offers a desired combination of comfort, compactness, and compatibility with institutional environments. Thus there is a need for a chair that is suitable for institutional environments, that is particularly comfortable, yet is inexpensive to produce, using a small number of component parts.

SUMMARY

The present invention meets this need by providing a chair that combines extraordinary comfort, sturdiness, cleanliness and simplicity that is inexpensive to produce and particularly suitable for institutional environments. In one aspect of the invention, the chair includes a base having (I) first and second leg members, each leg member being formed as an inverted U-shaped front and rear leg pair, and (ii) a rigid bar rigidly connecting the rear leg pairs at respective medial locations thereon; an elongate seat frame; a connector structure; a non-rigid tensile member for supporting an occupant of the chair; and a horizontally disposed spreader bar engaging the back segments and extending behind the tensile member. The term "non-rigid" as applied to the tensile member means that the tensile member is flexible in bending, but not necessarily flexible in tension (stretching). The seat frame has a U-shaped plan and front elevational configuration including a horizontal cross segment, rearwardly extending seat segments, and a generally L-shaped side elevational profile including the rearwardly extending seat segments and upwardly extending back segments. The connector structure joins the seat frame to the base with the front legs supporting the seat segments near the horizontal cross segment. Seat and back portions of the tensile member, engaging respective portions of the seat segments and the back segments of the seat frame, are tensioned by (I) the cross segment of the seat frame rigidly extending between and spacing front extremities of the seat segments; (ii) the spreader bar being spaced above the back legs for spacing the back segments of the seat frame; and the back segments extending rigidly from the back legs to above the spreader bar.

The connector structure can also include back leg connections between the rear legs of the base to the back segments of the seat frame near the seat segments; and the back leg connections can augment the tensioning by rigidly spacing the back legs at those connections. The connections can include respective frame fasteners: a pair of seat fasteners connecting respective seat segments of the frame proximate the cross segment to a corresponding front leg, and a pair of first back fasteners connecting respective back segments of the seat frame proximate the seat segments to a corresponding rear leg. Each back fastener can include a pair of fixedly spaced head members and a shank element that extends through adjacent walls of the respective leg members and the seat frame with the head members bearing against interior surfaces of the respective walls. Each back fastener can include a pair of threadingly engaged fastener elements, each head member being formed on one of the elements, a head member including an axially disposed engagement surface, the seat frame having wrench clearance openings formed therein concentric with the respective fasteners for passing a portion of a wrench from outside the seat frame to the engagement surface, the wrench clearance openings being for appearance sake not more than approximately 110 percent of a shank diameter of the fastener. Also, there can be a pair of second back fasteners that are vertically spaced from the first ones, for augmenting the strength of the connector structure without enlarging the fasteners.

The engagement of the flexible member with the seat frame can include the flexible member enclosing portions of the seat and back segments, the frame connections including spacers for rigidly spacing the leg members from the seat frame, thereby providing clearance for the flexible member, the flexible member having openings for enclosing the spacers. The engagement of the at least one flexible member with the seat frame can include the flexible member having a pair of back pockets enclosing upper extremities of the back segments, each back segment being formed with front and rear side walls thereof in facing contact at the respective upper extremities, each of the back segment extremities compressively engaging upper closures of the back pockets for vertically tensioning the at least one flexible member.

Preferably a front wall of each back segment is uniformly spaced from a tube centerline of the seat frame to a point proximate each upper extremity, an opposite rear wall of each back segment being formed smoothly converging into contact with the front wall proximate the upper extremity from a point below the contact for facilitating a smooth front contour of the back segments, and for limiting plan area exposure of the back pockets proximate the upper extremities of the back segments; thus the upper closures of the back pockets can be closure seams.

The seat segments of the frame can extend downwardly and rearwardly by an angle $\phi$ from horizontal, the angle $\phi$ being from approximately 5° to approximately 15°. Preferably the angle $\phi$ is between approximately 7° and approximately 11° for facilitating exit from the chair. More preferably, the angle $\phi$ is approximately 7.9°.

The back segments of the frame can extend upwardly and rearwardly generally by an angle $\psi$ from vertical, the angle $\psi$ being from approximately 25° to approximately 30°. Preferably the back segment portions of the frame extend at an included angle $\theta$ from the seat segments, the angle $\theta$ being from approximately 107° to approximately 115° for preventing hip joint dislocation, particularly for those having hip replacement surgeries. Most preferably the angle $\phi$ is approximately 8° and the angle $\theta$ is approximately 109°.

Lower portions of the back segments can be formed to include respective lumbar arches, each of the lumbar arches being centered a distance X from bottom surfaces of the seat segments, the distance X being preferably from approximately 5.1 inches to approximately 7.1 inches for locating lumbar area support resulting from the combination of the rigid contour of the seat frame and the non-rigid tensile support by the flexible member centered at the first or second lumbar vertebra approximately 6.1 inches above the seat portion of the seat frame. The lumbar arches of the back portion of the seat frame can be curved at a radius RC, the radius RC being preferably from approximately 4 inches to approximately 6 inches for extending, in combination with the non-rigid support an appropriate amount of pressure to the sacrum which in concert with the lumbar support maintains the spine in optimal curvature, the head in balance to minimize neck muscle strain, and rotates the pelvis to a desired position. More preferably the radius RC is approximately 4.3 inches and the distance X is approximately 6.1 inch.

DRAWINGS

These and other features, aspects, and advantages of the present invention will become better understood with reference to the following description, appended claims, and accompanying drawings, where:

FIG. 5 is a plan view of the base and frame portions of FIG. 2;

FIG. 6 is an exploded detail view of a fastener portion of the chair of FIG. 1;

DESCRIPTION

Figure 7:
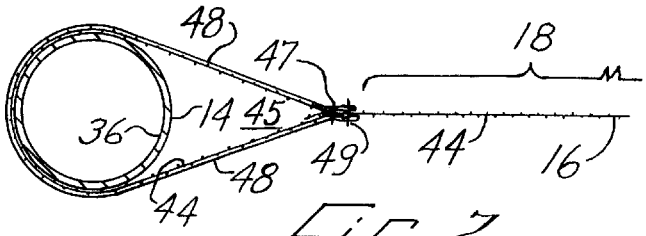
FIG. 7 is a sectional detail view showing a portion of the chair of FIG. 1.
Figure 2:
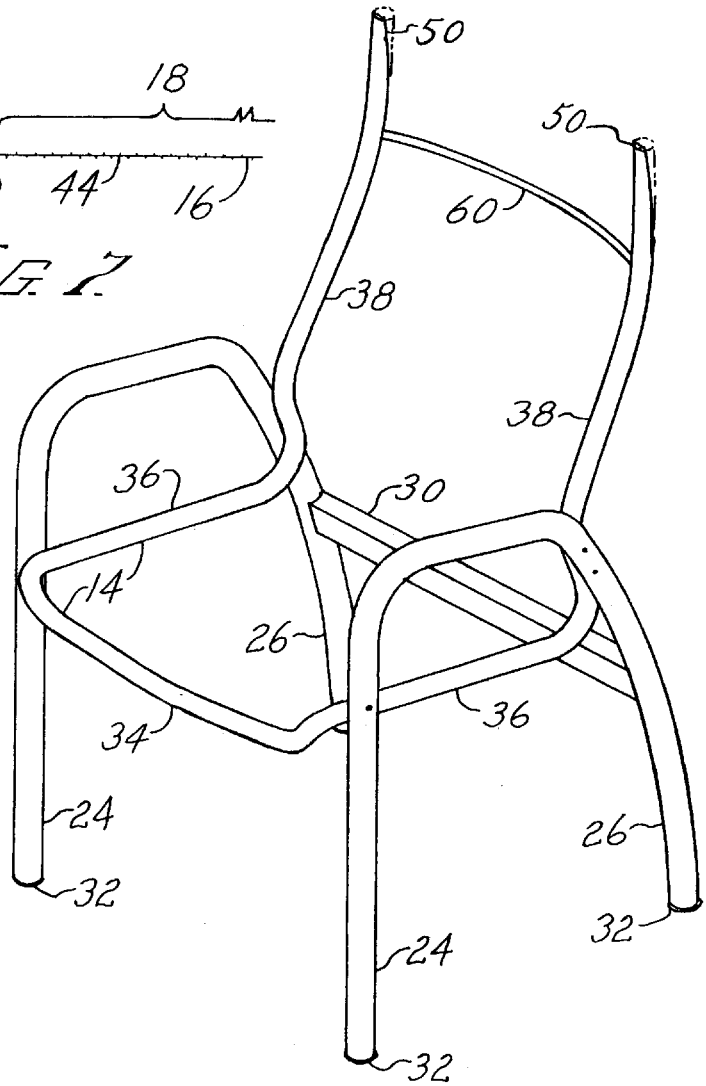
FIG. 2 is a right oblique elevational perspective view of base and seat frame portions of the chair of FIG. 1.

The present invention is directed to a chair that combines extraordinary comfort, sturdiness, cleanliness and simplicity, being inexpensive to produce and particularly suitable for institutional environments. With reference to FIGS. 1–7 of the drawings, a chair 10 includes a rigid base 12 and a substantially rigid, contoured seat frame 14 that is supported by the base 12, a tensile support 16 engaging the seat frame 14 and being tensioned thereby to create a comfortably contoured seat region 18 and back region 20 of the support 16 when the chair 10 is occupied by users having a variety of physical characteristics. The tensile support is flexible in bending, but is not necessarily flexible in tension (stretching).

The base 12 includes a laterally symmetric pair of tubular leg members 22, each of the leg members 22 being formed generally in an inverted U-shaped configuration including a front leg 24, a rear leg 26, and a connecting arm portion 28. The leg members 22 are spaced apart straddling the seat frame 14, the rear legs 26 being rigidly connected by a tubular bar 30, the bar 30 being horizontally disposed below the seat frame 14. Each of the front and rear legs 24 and 26 are preferably provided with conventional glides 32 that frictionally engage interior surfaces of the leg members 22 for supporting the base 12 on a suitable floor 33.

The seat frame 14 is formed of an elongate tubular member having an approximately U-shaped plan and front elevational profile including a horizontally disposed, upwardly bowed cross segment 34, rearwardly extending seat segments 36, and having an approximately L-shaped side profile including the rearwardly extending seat segments 36 and upwardly extending back segments 38. The seat segments 36 are connected proximate the cross segment 34 to the front legs 24 of the base 12 at an elevation A above the floor 33 by a pair of respective front fasteners 40. Similarly, the back segments 38 are connected proximate the seat segments 36 to the rear legs 26 of the base 12 at an elevation B above the floor 33 and at a spacing C above the elevation B by pairs of respective rear fasteners 42. In an exemplary and preferred configuration of the chair 10, the elevation A is approximately 17.25 inches, the elevation B is approximately 18.31 inches, and the spacing C is approximately 0.93 inch.

Figure 1:
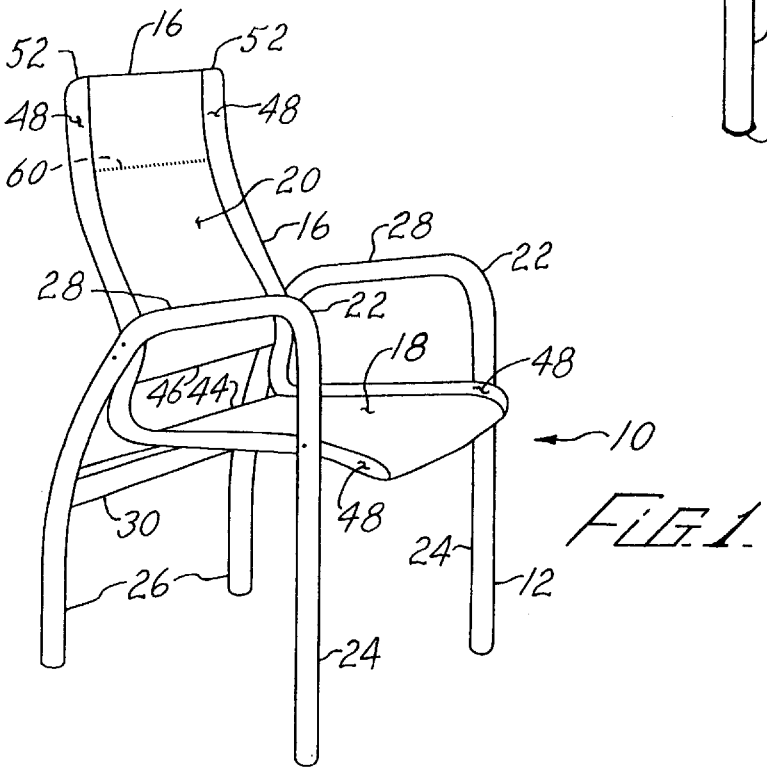
FIG. 1 is a left-oblique elevational perspective view of an institutional chair according to the present invention

The tensile support 16 includes a seat portion 44 that engages the cross and seat segments 34 and 36 of the seat frame 14, and a back portion 46 that engages the back segments 38. The seat and back portions 34 and 36 are generally configured as sheet members, the seat and back regions 18 and 20 being spaced apart as shown in FIG. 1. FIG. 7 shows attachment of the seat portion 44 to one seat segment 44, the attachment of the back portion 46 to the back segments being in like manner. The seat and back segments 36 and 38 of the frame 14 extend within respective hems or side passages 45 of the tensile support 16, the side passages 45 being closed by respective seams 47. The seat and back portions 44 and 46 of the tensile support 16, are preferably formed of materials having high tensile strength while being flexible in bending. Further, the seat region 18 and the back region 20 of the tensile support 16 are preferably formed of a non-absorbent material that is perforate or having an open weave for permitting air circulation therethrough. The use of perforate material the seat and back regions 18 and 20 advantageously permits passage of liquid contamination or rinsing liquids for facilitating cleaning and drying of the chair 10. Accordingly, a suitable "non-elastic" perforate material for use forming the seat portion 44 and the back portion 46 is made from vinyl-encased woven polyester strands. Such a material can be woven with 18 strands per inch in the direction of the seat and back segments 36 and 38, and 14 strands per inch in the direction of the cross segment 34, and having an elongation of from approximately 0.5 percent to approximately 1.5 percent in the direction of the segments 36 and 38 (warp), and from approximately 4 percent to approximately 5 percent in the direction of the segment 34 (fill), using test method TMS-TM-002 of Add Specialized Seating Technology of Los Angeles, Calif. The seat and back portions 44 and 46 are flexible in bending and can be substantially unyielding in tension, yet comfortably conforming to the body of an occupant of the chair 10 primarily by virtue of slight flexing of the seat frame 14 as described below. In one variation, even greater comfort is provided by a controlled amount of elastic stretching of the tensile support 16, the seat and back portions 44 and 46 being formed of an "elastic" material having elongation behavior that is characterized in Table 1.

TABLE 1

Elastomeric Fabric Elongation

| | Warp | | Fill | |
|---|---|---|---|---|
| Load (lb) | % Elong. | % Elong./lb | % Elong. | % Elong./Lb |
| 5 | 1.777 | 0.3554 | 2.774 | 0.5548 |
| 10 | 2.371 | 0.2371 | 3.863 | 0.3863 |
| 25 | 3.846 | 0.1538 | 6.279 | 0.2512 |
| 50 | 6.962 | 0.1392 | 9.727 | 0.1945 |
| 100 | 15.465 | 0.1547 | 16.909 | 0.1691 |

It is contemplated that the values given in Table 1 can vary approximately 15 percent without departure from the even greater comfort provided in the present invention by the elastic material.

Contrastingly, it is preferred that the tensile support 16 have smooth, non-absorbent outside surfaces proximate the side passages 45 for shielding corresponding portions of the seat frame 14 from contamination and/or retention of moisture by capillary attraction. For this purpose, the tensile support 16 is provided with respective marginal cover portions 48 when the seat and/or back portions 44 and 46 are made from a perforate or open mesh material. Each cover portion 48 extends about the corresponding seat and back segments 36 and 38 of the seat frame 14, over and in facing contact with the seat and back portions 44 and 46, being fastened thereto by a cover seam 49. A suitable material for the marginal portion 48 is conventional expanded vinyl upholstery.

The side passages 45 of the back portion 46 are closed at upper extremities 50 of the back segments 38 (See FIG. 2.) by respective seams 52 as shown in FIG. 1, each designation 52 referring collectively to one or separate seams of the back portion 46 and the corresponding cover portion 48. The seat portion 44 of the tensile support 16 wraps over and around the cross segment 34 of the seat frame 14, being fastened to a rear wall thereof by a plurality of screws 54 and a clamp strip 56, the tensile support 16 being folded over the clamp strip 56 as indicated at 58 in FIG. 4, the screws 54 threadingly engaging the rear wall of the cross segment 34 and extending through the clamp strip 56 and two thicknesses of the seat portion 44. Thus the tensile support 16 is longitudinally tensioned between the cross segment 34 and the upper extremities 50 of the back segments 38 by the combination of the clamp strip 56 holding the seat portion 44 against the cross segment 34, with the upper extremities 50 of back segments 38 engaging the seams 52 that form upper closures of the side passages 45. The seat and back portions 44 and 46 are connected by the cover members 48, and may also be connected by members extending within the cover members 48.

The tensile support 16 is also tensioned laterally between the seat and back segments 36 and 38 of the seat frame 14 as described herein, this being the dominant tensioning direction. Firstly, front extremities of the seat segments 36 of the frame 14 are rigidly spaced by the cross segment 34 extending generally horizontally therebetween, the cross segment 34 extending only slightly ahead of and below the seat segments 36, thereby being loaded primarily in compression in opposition to tension of the tensile support 16. Secondly, the tubular bar 30 rigidly spaces the rear legs 26 at the connection thereto, the rear legs 26 being sufficiently rigid above the bar 30 for rigidly spacing the rear fasteners 42, the rear fasteners 42 in turn rigidly spacing the back segments 38 thereat, and the seat segments 36 of the seat frame 14 rigidly extend between the cross segment 34 and the rear fasteners 42 for tensioning the seat portion 44 of the tensile support 16. Thirdly, a spreader bar 60 extends horizontally between upper portions of the back segments 38, the bar 60 protruding one wall and bearing against an opposite wall of each back segment 38 for semi-rigidly spacing same, the back segments 38 rigidly extending between the rear fasteners 42 and the upper extremities 50 thereof for tensioning the back portion 36 of the tensile support 16, the spreader bar 60 being deflected into a bowed shape by the tensioning of the back portion 36 The bar 60 is preferably formed of a high strength material such as spring steel for maintaining a compressive force of approximately 100 pounds between upper portions of the back segments 38 of the seat frame 14.

Figure 4:
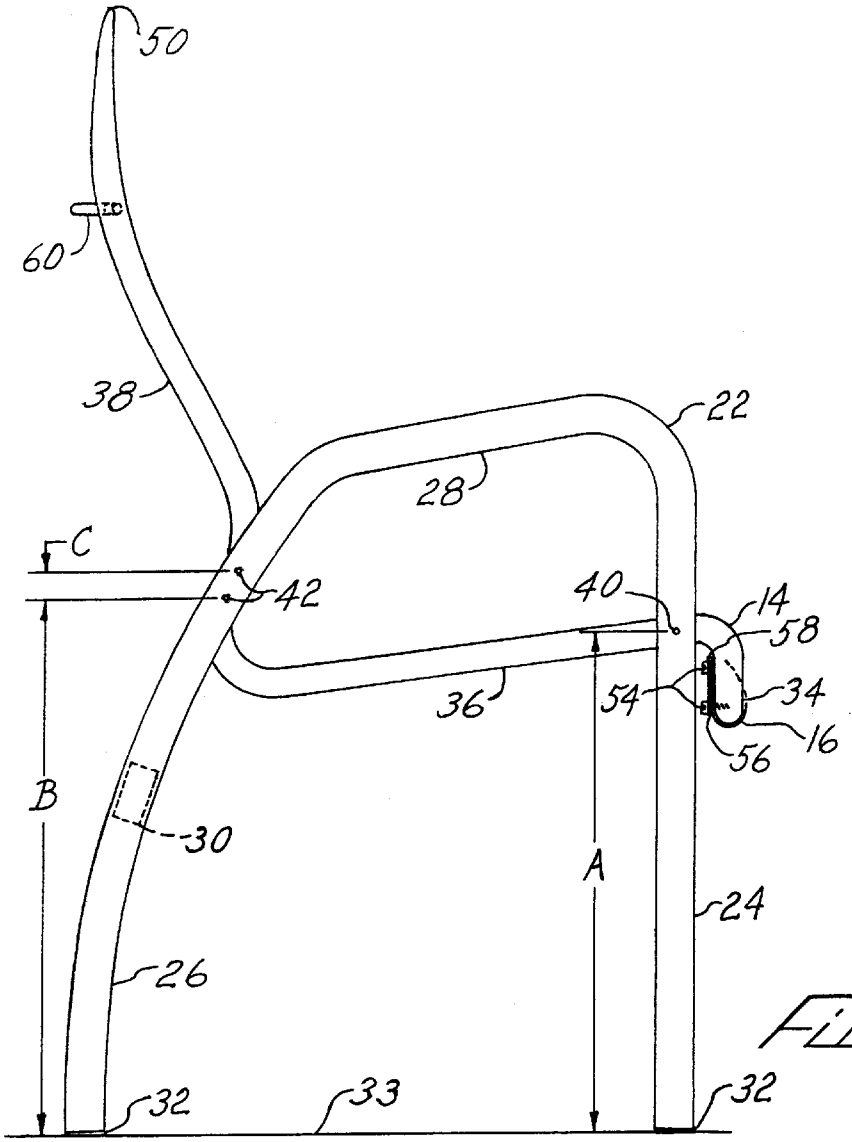
FIG. 4 is a right side elevational view of the base and frame portions of FIG. 2.
Figure 3:
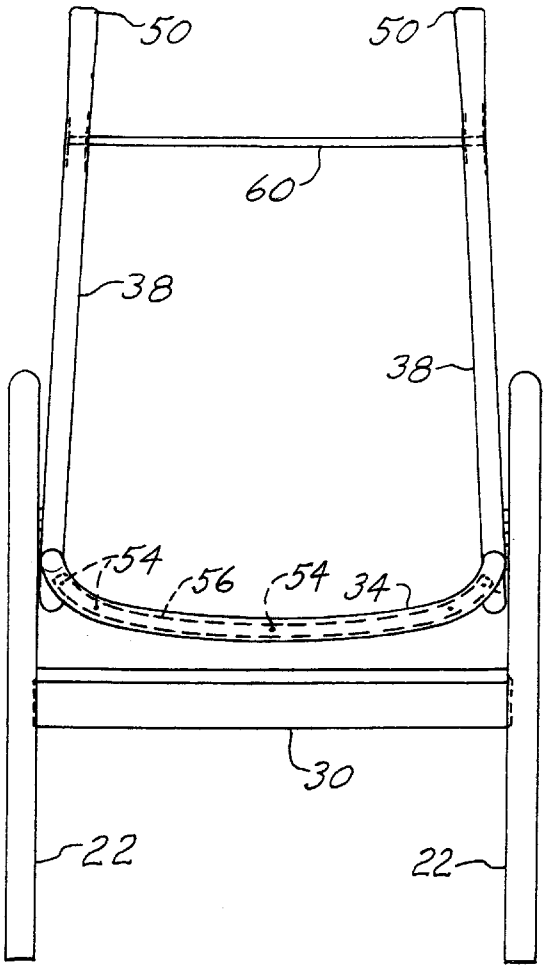
FIG. 3 is a front elevational view of the base and frame portions of FIG. 2.

As further shown in FIGS. 2–5 the upper extremities 50 of the back segments 38 are flattened by permanent deformation of the tubular material of the seat and back-supporting frame 14. As best shown in FIG. 4, the flattening is done primarily from the rear, forming a smoothly converging contour that extends upwardly from proximate the spreader bar 60 for preserving a smoothly curved front contour of the back segments 38. The upper extremities 50, being flattened as described above, fit into the closures of the side passages 45 of the flexible member 16, bearing against the seams 52 in a manner that presents minimal plan surface area, thereby contributing to cleanliness of the chair 10 in that the cover members 48 are less likely to retain falling food or other waste matter.

A preferred material for the leg members of the base 12 is available as extruded aluminum, or as conventional 1010 mild steel tubing of 1.38" O.D. 14–18 gauge wall thickness. A preferred material for the seat frame 14 is available as conventional 1010 mild steel tubing of 1.0" O.D. and 14 to 18 gauge wall thickness. A preferred material for the spreader bar 60 is high-carbon spring steel, which can be round in cross-section, having a diameter of approximately 0.31 inch. It has been experimentally determined that appropriate tensioning of the tensile support 16 is achieved when a standard load produces a predetermined vertical deflection of the tensile support 16. More particularly, the standard load is configured with a bottom surface having a surface area of approximately 3.0 square inches and weighing approximately 7.25 pounds. Proper tensioning of the seat portion 44 of the tensile support using the non-elastic mesh material is achieved when this load produces a vertical deflection of not more than 0.44 inch when applied approximately centered laterally and approximately 4 inches from the rear of the seat portion 44. Similarly, proper tensioning using the elastic material is obtained when the deflection is not more than 0.75 inch. Correspondingly, the tensioning of the back portion 46 is achieved when the vertical deflection is not more than 0.38 inch using the non-elastic material and 0.63 inch using the elastic material, the chair 10 being temporarily supported with the lumbar-thoracic portions 94 of the back segments 38 approximately horizontal.

As shown in FIG. 6, each rear fastener 42 includes a rivet nut 62 that is permanently installed engaging one wall of the back segment 38 of the seat frame 14 facing the rear leg 26, a cap screw 64 that extends through one wall of the rear leg 26 for threadingly engaging the rivet nut 62, and a rear spacer 66R for rigidly spacing the rear leg 26 from the back segment. Each front fastener 40 is similarly constructed, but with a front spacer 66F in place of the rear spacer 66R for providing clearance for the tensile member 16. The rear spacer 66R is slightly thicker than the front spacer 66F because the back segments 38 are inclined slightly inwardly and upwardly from the seat segments 36. It will be understood that all or a portion of each spacer 66 can be formed integrally with the corresponding rivet nut 62. For example, the rivet nut 62 can have a flange thickness of approximately 0.06 inch, the chair 10 not including separate front spacers 66F. Also, some or all of the spacers 66 can be omitted, the tensile support 16 being either cut away from interfering with the fastened tubular members or sandwiched therebetween. Thus it is contemplated that the chair 10 typically includes the rear spacers 66R only.

Further shown in FIG. 6 is a wrench 68 that is used through openings 70 in the leg member 22 for tightening the cap screws 64 of the rear fasteners 42 (and the front fasteners 40). Additionally shown in FIG. 6 is a reinforcing tube 72 that is optionally pressed into the back portion 38 of the seat frame 14 prior to installation of the rear fasteners 42 for stiffening the seat frame 14 proximate the fasteners 42.

Figure 8:
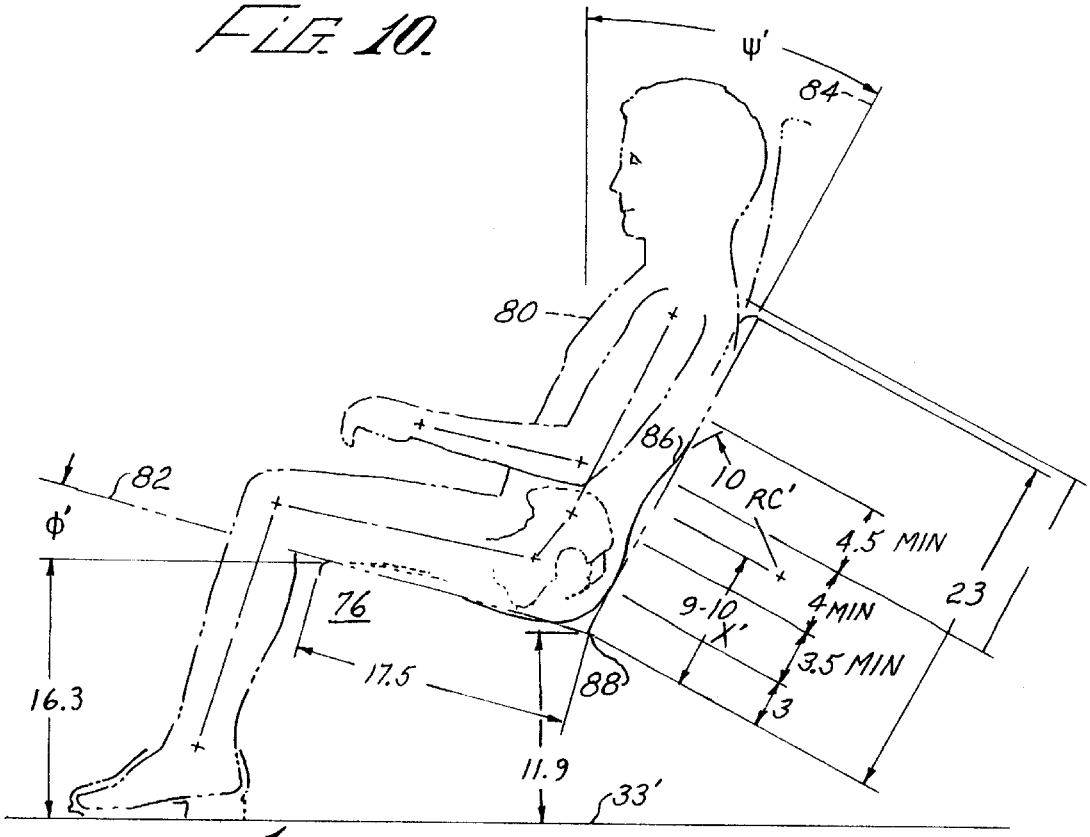
FIG. 8 (PRIOR ART)
FIG. 8 is a left side elevational diagram of a prior art seating recommendation.

FIG. 8 shows a "seating recommendation 74" that is published under the title, "Human Scale 1-2-3," researched and compiled by Henry Dreyfuss Associates. This publication is regarded by those having skill in the art as a principal definitive work in the field. The recommendation 74 includes a padded seat 76 and back 78 for supporting an occupant 80, the occupant 80 being supported proximately on a downwardly and rearwardly inclined seat plane 82 and an upwardly and rearwardly back plane 84, the back plane 84 being interrupted by an arcuate lumbar support region 86 of approximately 10 inch radius (Rc') that protrudes 0.6 to 1.0 inch ahead of the back plane 84 and is centered at a distance X' from 9 to 10 inches upwardly along the back plane from the seat plane 82. The seat plane 82 is inclined at an angle $\phi'$ that is not less than approximately 15° from the horizontal, and the back plane is inclined from the vertical at an angle $\psi'$ approximately 28°. For conversation, reading, and watching television, the recommendation 74 requires the angle $\psi'$ to be greater than the angle $\phi'$ by from 10 to 15°. An apex 88 of the seat plane 82 and the back plane 84 is located 11.9 inches above a supporting surface 33', a front extremity of the seat 76, 17.5 inches from the apex 88, is located 16.3 above the supporting surface 33'.

Figure 9:
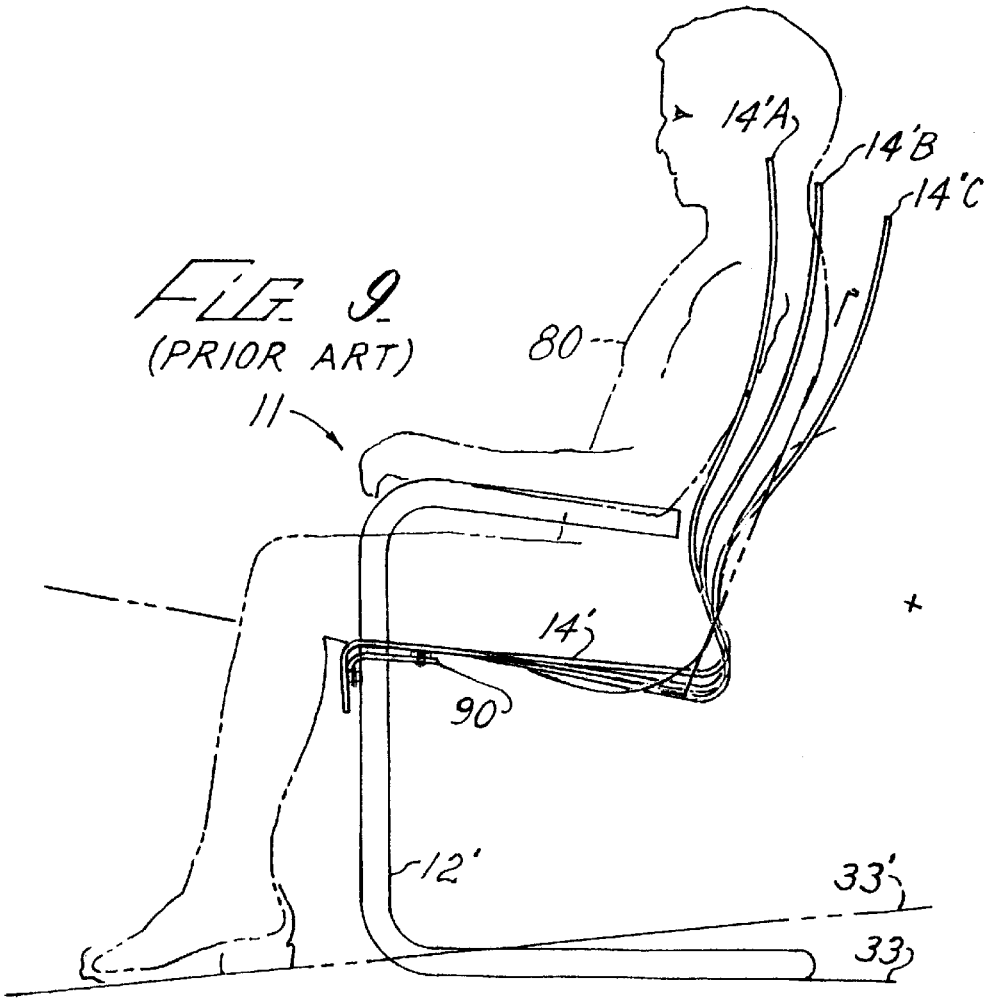
FIG. 9 (PRIOR ART)
FIG. 9 is a left side elevational view of a prior art chair in relation to the diagram of FIG. 8.

With further reference to FIG. 9, the recommendation 74 of FIG. 8 is superimposed on a side elevational view of a version of the chair that is disclosed in U.S. Pat. No. 4,784,435 designated chair 11. The chair 11 corresponds generally to FIG. 2 of the '435 patent, having a base 12', oppositely disposed seat and back-supporting members 14', and a mount 90 flexibly coupling each member 14' to the base 12', but with the members 14' elongated upwardly in a"high-back" configuration as in FIGS. 7–9 of the '435 patent. The flexibility of the members 14' in combination with the mounts 90 is depicted at 14'A, representing an unloaded condition, 14'B, representing loading by a 125 pound short female occupant, 14'C, representing a 220 pound tall male occupant, the recommendation 74 representing an average adult male weighing an average 153.1 pounds. Thus the position of the occupant 80 of the recommendation 74 is located intermediate the positions 14'B and 14'C in FIG. 9.

Figure 10:
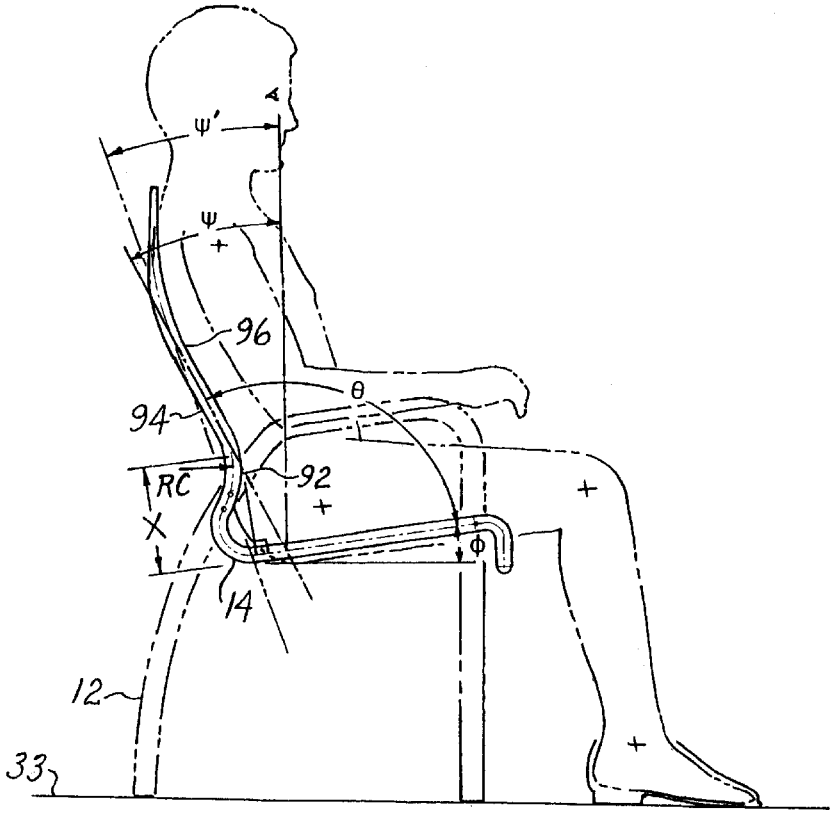
FIG. 10 is a right side elevational view of the chair of FIG. 1 in relation to an adaptation of the diagram of FIG. 8.
Figure 11:
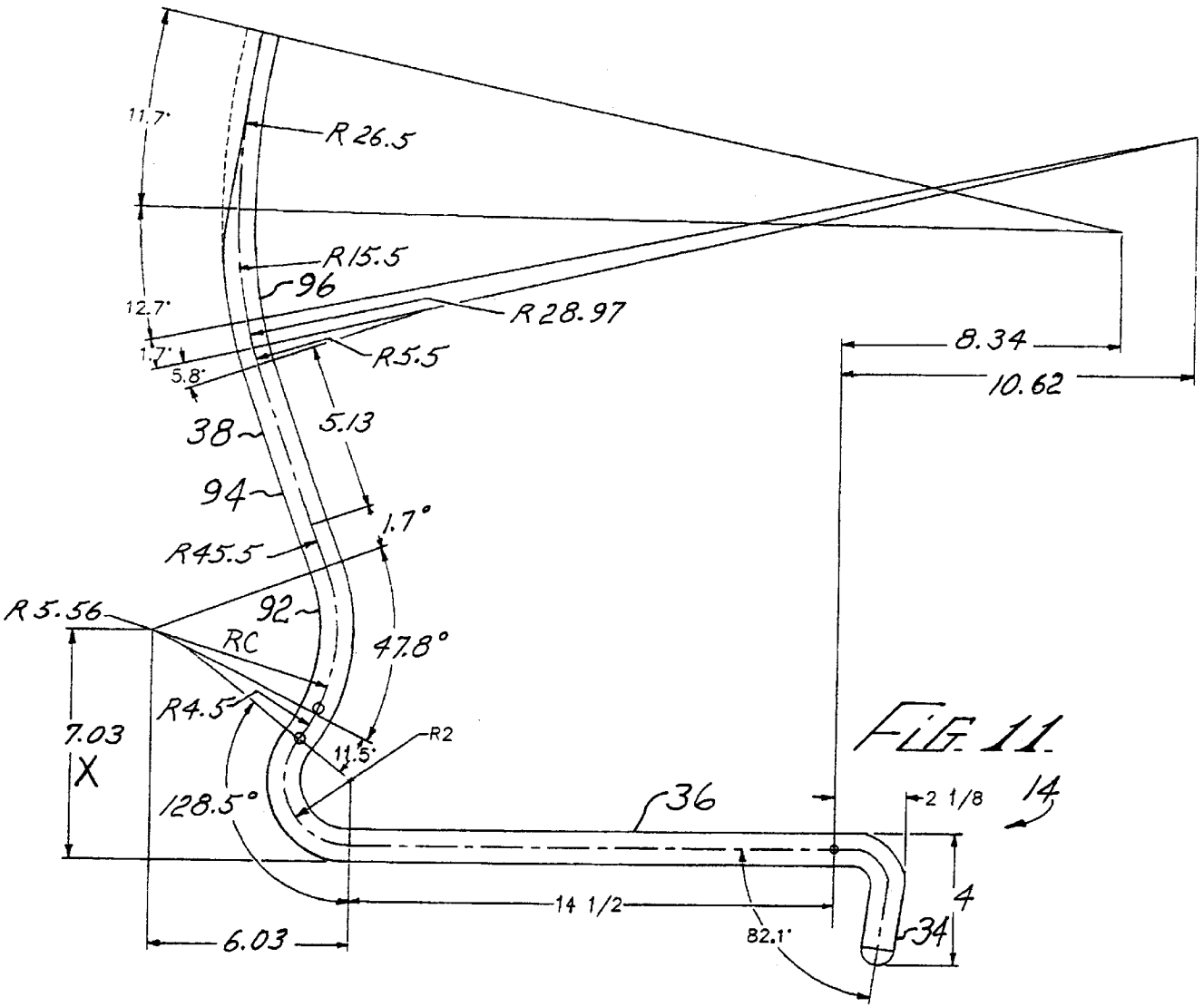
FIG. 11 is a right side elevational view of a seat frame portion of the chair of FIG. 1.

With further reference to FIGS. 10 and 11, FIG. 10 shows the recommendation 74 is superimposed on the chair 10 of the present invention in a manner similar to that of FIG. 9, but with the lower legs of the occupant 80 more vertically oriented, the ankle joints being moved rearwardly to the point of being nearly under the knee joints.

An important feature of the present invention is that the shape and physical properties of the seat frame 14, in combination with the tensile support 16, provide an especially advantageous combination wherein the chair 10 is particularly comfortable to occupants having a variety of physical characteristics. Also, the chair 10 is notably easy to get out of, particularly in clinical settings wherein many of the occupants are physically infirm. It has been unexpectedly discovered that, as contrasted with the prior art, improved comfort and physical well-being is provided by centering lumbar area support sufficiently low that supportive pressure is applied against the sacrum. Accordingly, the seat frame 14 is formed with a lumbar arch portion 92 that is centered at a distance X from the seat segments 36, the distance x being preferably between approximately 5.1 inches and approximately 7.1 inches as measured perpendicular to bottom surfaces of the seat segments 36. The arch portion 92 is formed at a radius RC that is preferably relatively small, being from approximately 4 to approximately 6 inches, 4.5 inches being most preferred, for extending an appropriate amount of pressure to the sacrum which in concert with the lumbar support rotates the pelvis to a desired position, which in turn positions the spine into a desired curvature. A lumbar-thoracic portion 94 of each back segment is substantially straight for supporting the upper-lumbar and lower thoracic portions of the spine which, in combination with the flexible member 16 being properly tensioned, produces a transition curvature of the back portion 20 in corresponding regions thereof that contact the occupant. Finally, a lordotic portion 96 of each back segment 38 curves upwardly and forwardly from the lumbar-thoracic portion 94 as best shown in FIG. 11, for aligning the spine and thrusting the rib cage upwardly and forwardly, thereby allowing the diaphragm to drop more effectively, facilitating easy and adequate respiration. It will be understood that the shape of the frame 14, in combination with the tensile member 16, yields a sit that is particularly advantageous in patient room uses, in the acute, long-term, and home care sectors.

Further, the combination of the base 12 and the seat frame 14 is substantially rigid, resulting in the seating position for occupants of widely ranging physical weights being essentially the same. This is in contrast to chairs that utilize soft padding and/or spring members that support the occupant variously according to the particular weight loading imparted to the structure. Moreover, the chair 10 does not flex appreciably in the configurations described herein, having one fixed angle (θ) between the seat and back, another fixed angle (ϕ) of inclination of the seat, and one fixed profile of the back. Significantly, the angle ϕ is only approximately 8° (more accurately, 7.9°), resulting in a higher seating height than that of the recommendation 74, and the angle θ is approximately 109°, the angle between the femur and the spine being also increased over that of the recommendation 74. The higher seating height advantageously changes the angle of the femur relative to the floor 33, making exiting significantly easier. The increased opening between the femur and the spine also is much safer on the hip joints, particularly for those having hip replacement surguries, for preventing dislocation.

Although the present invention has been described in considerable detail with reference to certain preferred versions thereof, other versions are possible. For example, the chair can be made stackable by substituting smaller diameter tubing or solid rod for the tubular leg members 22. The base 12 can be formed principally of wood. A plurality of seat frames 14 can be mounted on a single beam-type base for multiple seating, the rear mounting being proximate rear extremities of the seat portions of each seat frame 14. Also, the seat frame can be connected to the rear legs in a manner permitting movement in a vertical plane in combination with a biasing element, the frame pivoting about the seat fasteners 40 for providing a rocking motion of the chair There can be a spaced plurality of spreader bars 60. Therefore, the spirit and scope of the appended claims should not necessarily be limited to the description of the preferred versions contained herein.

What is claimed is:

1. A chair comprising:

(a) a base;

(b) a spreader bar;

(c) an elongate seat frame, the seat frame having a U-shaped plan and front elevational configuration including a horizontal cross segment, rearwardly extending seat segments, and an approximately L-shaped side elevational profile including the rearwardly extending seat segments and upwardly extending back segments, wherein:

(i) the cross segment of the seat frame rigidly extends between the seat segments, thereby rigidly spacing front extremities of the seat segments;

(ii) the spreader bar engages the back segments in horizontally spaced relation above the seat segments for spacing upper portions of the back segments; and (iii) the seat and back segments of the seat frame extend in rigidly spaced relation from the cross segment to above the spreader bar;

(d) a connector structure connecting the seat frame to the base, the connector structure rigidly spacing the seat frame proximate rear extremities of the seat segments;

(e) a tensile member having a seat portion engaging respective portions of the seat segments and a back portion engaging the back segments of the seat frame for supporting an occupant of the chair, the spreader bar extending behind the back portion of the tensile member, the tensile member being tensioned between opposite sides of the seat frame, wherein the engagement of the tensile support with the seat frame includes the tensile support including a back portion having a pair of back pockets having respective upper closures, the pockets enclosing upper extremities of the back segments, each back segment of the seat frame being formed with front and rear side walls thereof in facing contact at the respective upper extremities, each of the back segment extremities compressively engaging the upper closures of the back pockets for vertically tensioning the back portion of the tensile support, and wherein a front wall of each back segment is uniformly spaced from a tube centerline of the seat frame to a point proximate each upper extremity, and an opposite rear wall of each back segment is formed smoothly converging into contact with the front wall proximate the upper extremity from a point below the contact for facilitating a smooth front contour of the back segments, and for limiting plan area exposure of the back pockets proximate the upper extremities of the back segments.

2. The chair of claim 1, wherein:

(a) the base is rigid, comprising first and second leg members, each leg member being formed generally as an inverted U-shaped front and rear leg pair, the leg pairs being rigidly joined in symmetrically spaced relation by a rigid bar, the bar connecting respective rear legs of each pair at a medial location thereon;

(b) lower portions of the back segments are formed to include respective lumbar arches, each of the lumbar arches being centered a distance X from bottom surfaces of the seat segments, the distance X being approximately 6.1 inches, the lumbar arches being curved at a radius RC of approximately 4.3 inches;

(c) the connector structure connects the seat frame to the base with the front legs supporting the seat segments proximate the cross segment, and the rear legs rigidly supporting the back segments of the frame proximate the seat segments thereof;

(d) the spreader bar is spaced above the back legs for spacing upper portions of the back segments; and (e) the seat and back segments of the seat frame extend in rigidly spaced relation from the front legs, to the connector structure at the rear legs, and to above the spreader bar.

3. The chair of claim 1, wherein the connector structure further includes rear leg connections between rear legs of the base to the back segments of the frame proximate the seat segments thereof.

4. The chair of claim 3, wherein the tensioning of the tensile member is augmented by the further combination of a rigid bar and the rear legs above the bar cooperating to rigidly space the respective rear leg connections.

5. The chair of claim 1, wherein the connector structure comprises a plurality of frame fasteners, including:

(a) a pair of seat fasteners, each seat fastener connecting one seat segment of the frame proximate the cross segment to a respective front leg; and (b) a pair of first back fasteners, each back fastener connecting one back segment of the frame proximate the seat segment to a respective rear leg, the second back fasteners being vertically spaced from the first back fasteners.

6. The chair of claim 3, wherein at least some of the frame fasteners each include a pair of fixedly spaced head members and a shank element, the shank element extending through adjacent walls of one leg member and the seat frame with each head member bearing against an interior surface of the respective wall.

7. The chair of claim 6, wherein each headed frame fastener comprises a pair of threadingly engaged fastener elements, each head member being formed on one of the elements, at least one of the head members including an axially disposed tool engagement surface for engagement by a wrench, the seat frame having wrench clearance openings formed therein concentric with the respective fasteners for passing a portion of the wrench from outside the seat frame into engagement with the tool engagement surface, the wrench clearance openings being not greater in diameter than approximately 110 percent of an outside diameter of the shank element.

8. The chair of claim 1, wherein the spreader bar is formed of a high strength spring material, being bowed by the tensioning.

9. The chair of claim 1, wherein the base comprises first and second tubular leg members.

10. The chair of claim 1, wherein the seat frame comprises a tubular member.

11. The chair of claim 1, wherein the engagement of the tensile support with the seat frame includes the tensile support enclosing portions of the seat and back segments.

12. The chair of claim 1, wherein the upper closures of the back pockets are closure seams.

13. The chair of claim 1, wherein the seat segments of the frame extend downwardly and rearwardly by an angle $\phi$ from horizontal, the angle $\phi$ being from approximately 5° to approximately 15°.

14. The chair of claim 13, wherein the angle $\phi$ is between approximately 7° and approximately 11°.

15. The chair of claim 14, wherein the angle $\phi$ is approximately 7.9°.

16. The chair of claim 1, wherein back segment portions of the frame extend upwardly and rearwardly generally by an angle $\psi$ from vertical at an elevation that is effective for contouring a portion of the tensile support to support a lumbar-thoracic region of an occupant of the chair, the angle $\psi$ being from approximately 25° to approximately 30°.

17. The chair of claim 16, wherein the back segment portions of the frame extend at an included angle $\theta$ from the seat segments, the angle $\theta$ being from approximately 107° to approximately 115°.

18. The chair of claim 17, wherein the seat segments of the frame extend downwardly and rearwardly by an angle $\phi$ from horizontal, the angle $\phi$ being from approximately 7° to approximately 11°.

19. The chair of claim 18, wherein the angle $\phi$ is approximately 7.9° and the angle $\theta$ is approximately 109°.

20. A chair comprising:

(a) a base comprising first and second tubular leg members, each leg member being formed as an inverted U-shaped front and rear leg pair, the leg pairs being rigidly joined in symmetrically spaced relation by a rigid bar, the rigid bar connecting respective rear legs of each pair at a medial location thereon;

(b) an elongate tubular seat frame, the seat frame having a U-shaped plan and front elevational configuration including a horizontal cross segment, rearwardly extending seat segments, and an approximately L-shaped side elevational profile including the rearwardly extending seat segments and upwardly extending back segments, a front wall of each back segment being uniformly spaced from a tube centerline of the seat frame to a point proximate each upper extremity, and an opposite rear wall of each back segment is formed smoothly converging into contact with the front wall proximate the upper extremity from a point below the contact for facilitating a smooth front contour of the back segments;

(c) a connector structure connecting the seat frame to the base with the front legs supporting the seat segments proximate the cross segment and the rear legs supporting the back segments proximate the seat segments;

(d) a tensile support having a seat portion engaging the seat segments and a back portion engaging the back segments of the seat frame for supporting an occupant of the chair, the engagement of the tensile support with the seat frame including the back portion having a pair of back pockets enclosing upper extremities of the back segments, each back segment being formed with front and rear side walls thereof in facing contact at the respective upper extremities, each of the back segment extremities compressively engaging upper closures of the back pockets for vertically tensioning the back portion of the tensile support, the smoothly converging upper extremities of the back segments limiting plan area exposure of the back pockets proximate the upper extremities of the back segments; and (e) a horizontally disposed spreader bar extending behind the tensile support above the rear legs and engaging the back segments of the seat frame, wherein back segment portions of the frame extend upwardly and rearwardly generally by an angle $\psi$ from vertical at an elevation that is effective for contouring a portion of the tensile support to support a lumbar-thoracic region of an occupant of the chair, the angle $\psi$ being from approximately 25° to approximately 30° the seat segments of the frame extending downwardly and rearwardly by an angle $\phi$ from horizontal, the angle $\phi$ being from approximately 7° to approximately 11° the back segment portions of the frame extending at an included angle $\theta$ from the seat segments, the angle $\theta$ being from approximately 107° to approximately 115°, lower portions of the back segments being formed to include respective lumbar arches, each of the lumbar arches being centered a distance X from bottom surfaces of the seat segments, the distance X being from approximately 5.1 inches to approximately 7.1 inches, the lumbar arches being curved at a radius RC, the radius RC being from approximately 4 inches to approximately 6 inches, and wherein:

(i) the cross segment of the seat frame rigidly extends between the seat segments, rigidly spacing front extremities of the seat segments;

(ii) the connector structure in combination with the back legs and the rigid bar rigidly spaces the back segments at the rear legs, the frame rigidly extending between each of the back legs and the cross segment; and (iii) the spreader bar biasingly spaces the back segments, the back segments rigidly extending from the back legs to above the spreader bar.

21. A chair comprising:

(a) a base comprising first and second leg members, each leg member being formed generally as an inverted U-shaped front and rear leg pair, the leg pairs being rigidly joined in symmetrically spaced relation by a rigid bar, the bar connecting respective rear legs of each pair at a medial location thereon;

(b) an elongate seat frame, the seat frame having a U-shaped plan and front elevational configuration including a horizontal cross segment, rearwardly extending seat segments, and an approximately L-shaped side elevational profile including the rearwardly extending seat segments and upwardly extending back segments;

(c) a connector structure connecting the seat frame to the base with the front legs supporting the seat segments proximate the cross segment, and the rear legs supporting the back segments of the frame proximate the seat segments thereof, including a plurality of frame fasteners, including:

(i) a pair of seat fasteners, each seat fastener connecting one seat segment of the frame proximate the cross segment to a respective front leg; and (ii) a pair of back fasteners, each back fastener connecting one back segment of the frame proximate the seat segment to a respective rear leg, wherein at least some of the frame fasteners each include a pair of fixedly spaced head members and a shank element, the shank element extending through adjacent walls of one leg member and the seat frame with each head member bearing against an interior surface of the respective wall, each headed frame fastener comprises a pair of threadingly engaged fastener elements, each head member being formed on one of the elements, at least one of the head members including an axially disposed tool engagement surface for engagement by a wrench, the seat frame having wrench clearance openings formed therein concentric with the respective fasteners for passing a portion of the wrench from outside the seat frame into engagement with the tool engagement surface, the wrench clearance openings being not greater in diameter than approximately 110 percent of an outside diameter of the shank element;

(d) a tensile member having a seat portion engaging respective portions of the seat segments and a back portion engaging the back segments of the seat frame for supporting an occupant of the chair; and (e) a horizontally disposed spreader bar engaging the back segments of the seat frame and extending behind the back portion of the tensile member, wherein:

(i) the cross segment of the seat frame rigidly extends between the seat segments, thereby rigidly spacing front extremities of the seat segments;

(ii) the spreader bar is spaced above the back legs for spacing upper portions of the back segments; and (iii) the seat and back segments of the seat frame extend in rigidly spaced relation from the front legs to above the spreader bar, the tensile member being tensioned between opposite sides of the seat frame.

* * * * *

UNITED STATES PATENT AND TRADEMARK OFFICE

CERTIFICATE OF CORRECTION

PATENT NO. : 6,322,147 B1
DATED : November 27, 2001
INVENTOR(S) : Roger K. Leib

It is certified that error appears in the above-identified patent and that said Letters Patent is hereby corrected as shown below:

Column 10,
Line 62, delete “3” and substitute therefore -- 5 --;

Column 12,
Line 30, after “30°” insert -- , --;
Line 33, after “11°” insert -- , --.

Signed and Sealed this

Twenty-fourth Day of June, 2003

JAMES E. ROGAN
*Director of the United States Patent and Trademark Office*